United States Patent [19]

Langenberg et al.

[11] 4,251,958

[45] Feb. 24, 1981

[54] SURFACE FINISHING DEVICE

[75] Inventors: Anthony J. Langenberg, Brockville; Sheldon L. Atos, Mallorytown, both of Canada

[73] Assignee: Black & Decker Inc., Newark, Del.

[21] Appl. No.: 10,911

[22] Filed: Feb. 9, 1979

[51] Int. Cl.[3] ..... B24D 9/06

[52] U.S. Cl. ..... 51/335

[58] Field of Search ..... 51/334, 335, 336, 337; 30/276, 347; 56/12.7; 242/211, 212; 312/39, 40; 225/16, 23, 25

[56] References Cited

U.S. PATENT DOCUMENTS

| | | | |
|---|---|---|---|
| 742,376 | 10/1903 | Arnold | 242/211 |
| 1,084,598 | 2/1914 | Antone | 312/39 |
| 2,600,613 | 6/1952 | Bruner et al. | 51/335 |
| 2,601,499 | 6/1952 | Bruner | 51/335 |
| 2,709,323 | 5/1955 | Swan | 51/335 |
| 2,713,237 | 7/1955 | Monjar | 51/335 |
| 2,713,759 | 7/1955 | Swan | 51/335 |
| 2,771,721 | 11/1956 | Reiman | 51/335 |
| 3,132,452 | 5/1964 | Block | 51/335 |

*Primary Examiner*—Othell M. Simpson
*Assistant Examiner*—K. Bradford Adolphson
*Attorney, Agent, or Firm*—Leonard Bloom; Edward D. Murphy; Harold Weinstein

[57] ABSTRACT

An improved flap sanding, surface finishing device is described having a manually operable member positioned outside a housing of the device for unwinding an abrasive strip stored in the housing in order to replenish worn strip segments. The device includes means for selectively inhibiting and enabling unwinding.

12 Claims, 8 Drawing Figures

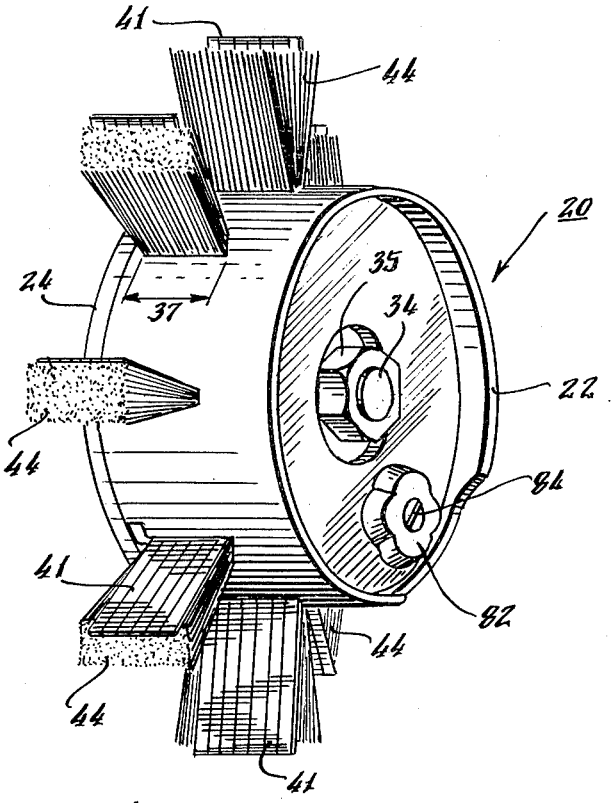
Fig. 1.
Fig. 4.
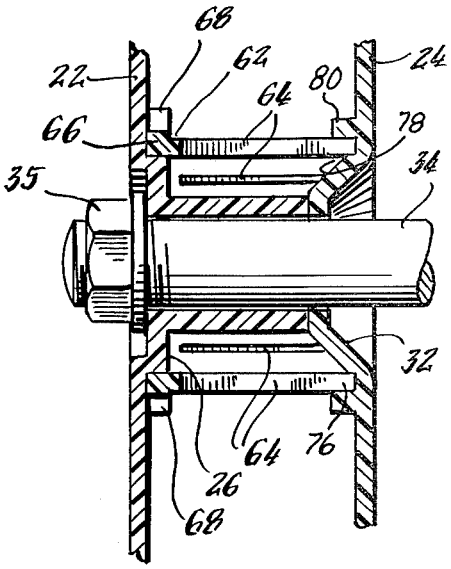
Fig. 2.
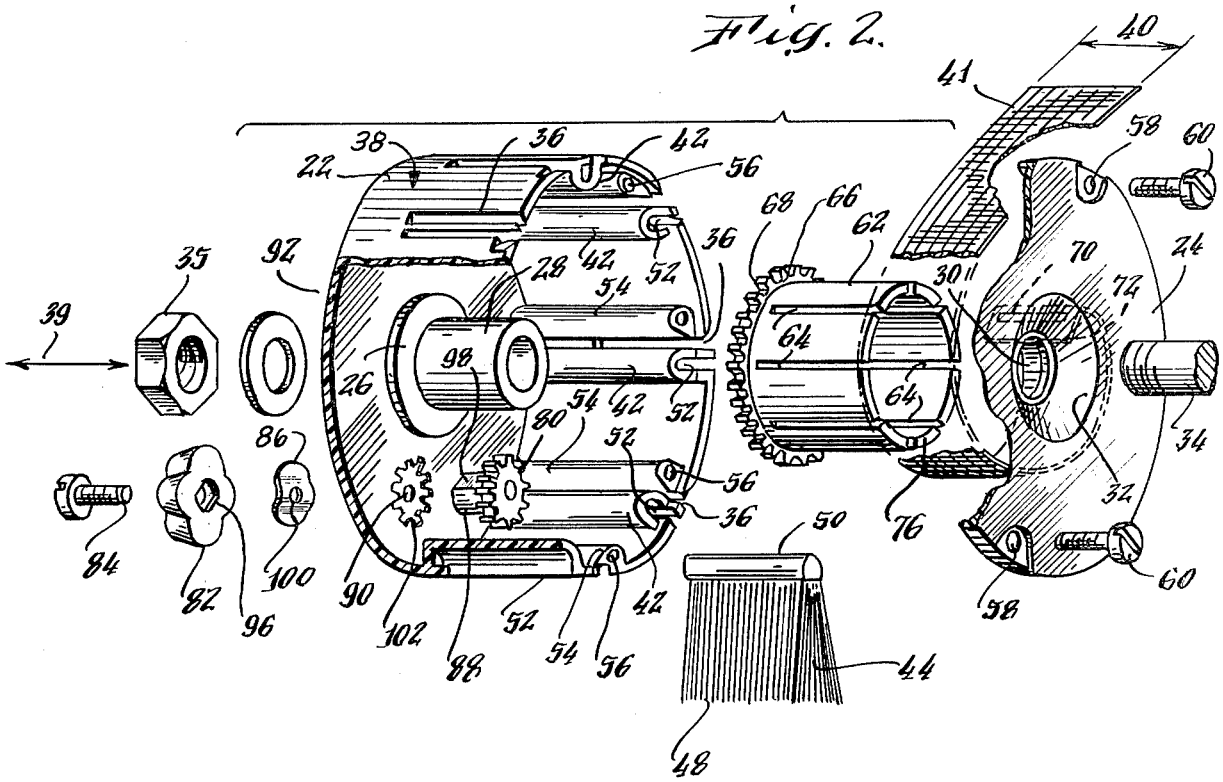

SURFACE FINISHING DEVICE

BACKGROUND OF THE INVENTION

1. Field of the Invention

The present invention relates to surface finishing devices which are adapted to be mounted for rotation on a spindle. The invention relates more particularly to an improved form of rotary flap sanding device.

2. Description of the Prior Art

A known form of a rotary surface finishing device, commonly referred to as a flap sander, comprises an array of elongated, flexible, abrasive strips which extend in a generally radial direction from a peripheral surface of a cylindrically shaped housing body. The strips are spaced uniformly about the periphery and each is maintained in a radially extending attitude during rotation by an adjacent backing body of a resilient material. The backing body is typically a bristle brush, which is mounted in juxtaposed relationship with the strip for rotation therewith. In operation, the housing is mounted on a spindle; it is rotated about its longitudinal axis; and, the device and a surface of a workpiece being finished are relatively positioned for contacting the surface with the rotating abrasive strips. During rotation as well as upon contact with the workpiece surface, the strips are deflected in a circumferential direction which is opposite to the direction of rotation. Deflection is limited during rotation, during contact and after contact by the adjacent resilient body. The rotating abrasive strips, which are flexible and yield upon contact, provide a device which advantageously enables finishing of surfaces having various configurations. A tool with which this flap sanding device is used is disclosed in copending U.S. patent application Ser. No. 010,912 which is filed concurrently herewith and assigned to the assignee of this invention.

Continued usage results in wear of extending working segments of the abrasive strips. In order to replace the worn segments, each abrasive strip is formed as an elongated body, a principal segment of which is stored in the housing member. The elongated strips extend from the housing interior through a slot in the peripheral surface and an external strip end segment provides the working abrasive surface. The plurality of abrasive strips have been wound on a reel within the housing. A means is provided for partly unwinding the reel in order to advance replacement segments of the strips from the interior of the housing to replenish the worn segments. The sanding flap wheel can thus be utilized over an extended period of time before the strips themselves need be replaced. Heretofore, the means provided for advancing the elongated strips from the housing have been relatively complex and costly and have required the user to, at least partly, disassemble the housing or adjust a housing cover in order to effect replenishment.

SUMMARY OF THE INVENTION

Accordingly, it is an object of this invention to provide a flap wheel sanding device having an improved means for advancing an elongated abrasive strip from the interior of a housing for replenishing an exterior working segment.

Another object of the invention is to provide a flap wheel sanding device wherein a replenishment abrasive strip is advanced from a housing interior while avoiding disassembly of the housing or adjustment of a housing cover.

Another object of the invention is to provide a flap sanding device having an abrasive strip advancing means which facilitates replenishment of a worn segment.

Another object of the invention is to provide an abrasive strip advancement means for a flap sanding device which can be fabricated at relatively low cost.

A further object of the invention is to provide an improved abrasive strip advancement means having a means for alternatively inhibiting and enabling unwinding of a strip support reel.

Still another object of the invention is to provide an abrasive strip advancing means having a lock and strip advance control which can be actuated from without the housing.

A further object of the invention is to provide an improved flap sanding device.

In accordance with features of the invention, an improved rotary flap sanding device is provided having a housing body and an elongated, flexible abrasive strip positioned within the housing body. The housing body is adapted to be mounted on a spindle for rotation of the housing about its longitudinal axis. A segment of the flexible abrasive strip extends through a slot in a peripheral surface of the housing body, and, in a generally radial direction therefrom. A means is provided for advancing the flexible abrasive strip to replenish the extending exterior segment upon wear of the exterior segment. Advancement is accomplished by partly unwinding the flexible strip from a reel about which it is wound and by a subsequent application of force to the strip in a generally radial direction. This force is applied automatically by centrifugal forces as the housing is initially rotated on the spindle, or alternatively, it is applied manually prior to rotation. A strip advancing means includes an actuating member which is positioned without the housing and is hand operable to cause rotation of the reel and unwinding of the abrasive strip within the housing. A means biases the hand operable member to a first position for inhibiting rotation of the reel and unwinding of the strip. It is alternatively operable to a second position to enable and actuate rotation of the reel and unwinding of the strip.

In accordance with a preferred embodiment of the invention, the housing body includes a generally cylindrically shaped member and a closure member, a reel rotatably positioned about a hub in the housing, a plurality of elongated flexible abrasive strips wound about the reel, and a plurality of slots formed in a peripheral surface of the housing and extending in the direction of the housing's longitudinal axis. Each of the flexible strips extends through an associated slot in a general radial direction. A resilient means is positioned adjacent each exterior strip segment. A means is provided for causing rotation of the reel about the hub, for rotating the reel, and for unwinding the strips. The reel rotating means includes a hand operable actuating member positioned exterior of the housing and operable between first and second positions for inhibiting rotation of the reel at the first position and for enabling rotation of the reel at the second position. Actuation of the member at the second position causes rotation of the reel.

In a more particular embodiment of the invention, the strip advancing means includes gear teeth formed in the reel and a reel gear which engages the gear teeth and is mechanically coupled to the external actuating member.

A means is provided for biasing the external member and the reel gear to the first position, for inhibiting rotation of the reel gear at the first position and for enabling rotation of the reel gear at the second position. The external member and reel gear are biased to the inhibit position in an axial direction and are hand actuatable in a second opposite axial direction to the second position for enabling the rotation of the reel gear. The external member is manually rotatable at the second position for causing rotation of the reel gear and the reel which it engages. A means for inhibiting rotation of the reel gear comprises a recess formed in a housing wall for receiving the reel gear. The recess conforms with and engages the reel gear configuration at the first axial position. In an alternative arrangement, the inhibiting means comprises a body extending from a surface of the housing for engaging the reel gear at the first position.

BRIEF DESCRIPTION OF THE DRAWINGS

These and other objects and features of the invention will become apparent with reference to the following specification and to the drawings wherein:

FIG. 1 is a perspective view of a flap wheel finishing device constructed in accordance with features of this invention;

FIG. 2 is an exploded, partly cut away view of the flap wheel finishing device of FIG. 1;

FIG. 4 is a fragmentary, sectional view taken along line 4—4 of FIG. 3;

DETAILED DESCRIPTION

Figure 3:
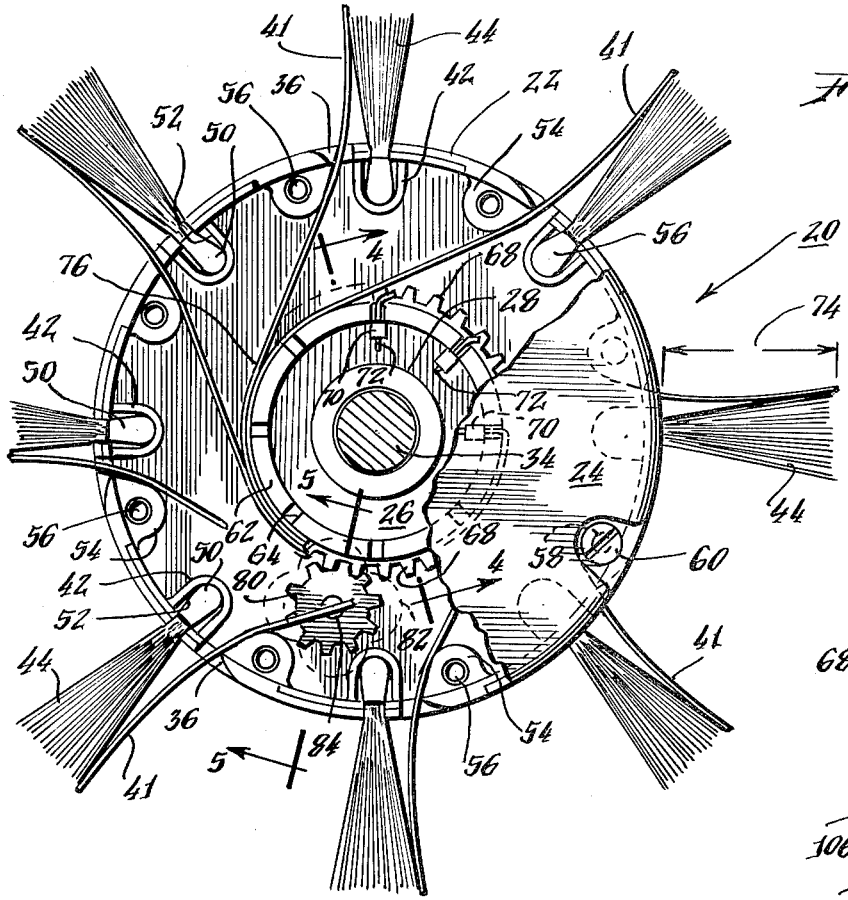
FIG. 3 is an enlarged plan view, partly cut away and partly in section of the device of FIG. 1.

Referring now to the drawings, a rotary flap sanding device referenced generally by numeral 20 includes a housing body comprising a first generally cylindrically shaped member 22 and a second disc shaped closure member 24. The housing member 22 includes an internally positioned integrally formed hub 26 and an integrally formed tubular segment 28 which is centrally located and which extends to an aperture 30 in a centrally located recessed segment 32 of the closure member 24. The tubular segment 28 and the aperture in the closure member 24 adapt the housing body for mounting on a spindle 34 for rotation therewith and to which it is secured by a nut 35.

Housing member 22 further includes a plurality of slots 36 which are formed in a peripheral wall 38 of the member and which extend in a longitudinal direction 39. Each of the slots 36 had a length 37 which is at least equal in magnitude to the width 40 of an abrasive strip 41. A plurality of sockets 42 are also provided and are integrally formed with the wall 38 of member 22 for receiving an associated plurality of resilient bodies 44. The resilient bodies 44 comprise, in a preferred embodiment, a brush which is formed from a plurality of bristles 48 which are secured by a bristle clamp 50. The clamp 50 is configured to conform with the shape of the socket 42, to be recessed therein and to be captivated by the socket. A plurality of brush slots 52 are formed in the wall 38 adjacent the socket 42. Brush bristles 48 extend from the socket 42 and through the slots 52. These slots which are formed in the peripheral surface 38 and extend in a longitudinal direction, form juxtaposed pairs with the abrasive strip slots 36. An array of these slot pairs are uniformly spaced about the peripheral surface 38. The member 22 further includes a plurality of integrally formed bosses 54 having bores 56 formed therein. Upon assembly of the closure member 24 and the cylindrical member 22, apertures 58 formed in the closure member align with the bores 56 of the bosses 54 and screws 60 extending therethrough engage the bores and secure the closure member to the cylindrical member 22.

A plurality of abrasive strips 41 (FIG. 3) are positioned within the interior of the housing body and are wound on a reel 62. The reel comprises a tubular support body having a longitudinal axis extending in the direction 39 a plurality of slots 64 formed in a wall and extending in the axial direction 39. A distal segment of the body includes a flange 66 having a plurality of gear teeth 68 formed therein. The tubular reel 62 has an inner diameter which conforms with an outer diameter of the hub 26 and the reel is rotatably positioned about the hub. Each of the flexible abrasive strips 41 is anchored to the reel 62 and the strips are wound in layers about the reel. The slots 64 along with staples 70 which are crimped at distal segments 72 of each of the strips provide a means for anchoring each of the strips to the reel. As shown in FIG. 3 a segment 72 of each of the abrasive strips 41 extends through an associated slot 64 in the reel and the staple 70 inhibits withdrawal of the strips from the slot 64. The strips 41 are uniformly wound in layers on the reel 62 by initially anchoring each strip in an associated reel slot 64 and leading the strip through an associated slot 36 in the peripheral surface 38. When the array of strips is assembled in this manner each of the strips 41 extends radially from its anchoring slot 64 and through the peripheral slot 36. The reel 62 is then wound in a counterclockwise direction as viewed in FIG. 3 to form a plurality of overlaying layers about the reel 62. The reel is wound by means indicated hereinafter. During the strip winding process, a length is left extending from the housing 22 to provide a working segment 74.

Upon assembly of the closure member 24 with the cylindrical member 22, a distal segment 76 of the reel 62 is positioned in a circular cavity 78 (FIG. 4) which is formed in the closure member 24 by a circular shaped, integrally formed flange 80 and by the recessed segment 32. The reel 62 is thus supported at both of its distal segments during rotation of the housing body.

Figure 5:
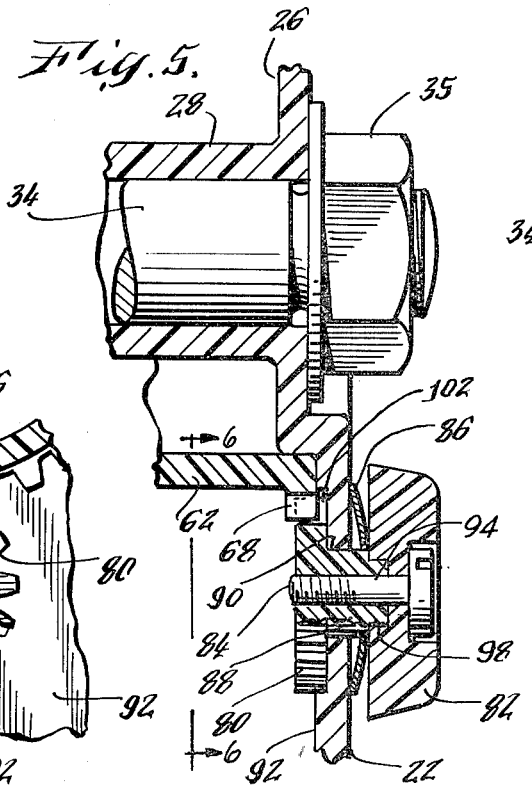
FIG. 5 is an enlarged, fragmentary, sectional view taken along lines 5—5 of FIG. 3 and illustrating an abrasive strip advancing means in a first advance-inhibiting position.
Figure 7:
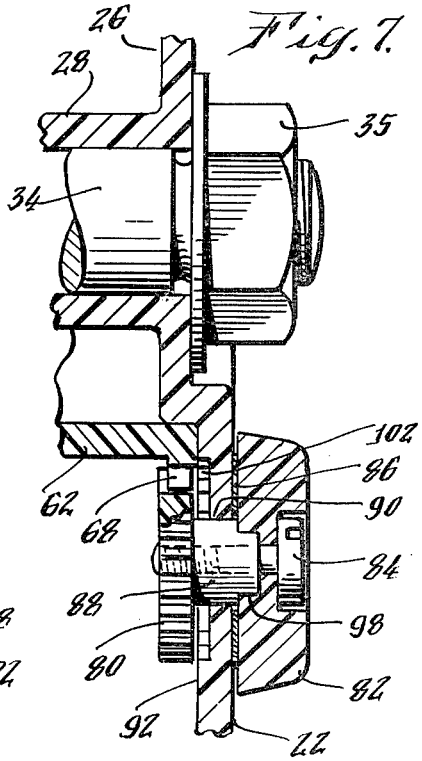
FIG. 7 is another view of the abrasive strip advancing means of FIG. 5 which illustrates the strip advancing means in a second advance-enabling position; and, FIG. 8 is a fragmentary view, of an alternative embodiment of the reel gear inhibiting means of FIG. 6.

A strip advancing means is provided for winding strips 41 about the reel 62 and for unwinding the strips at such times as it is desired to provide a replacement for the worn working segments 74. This advancing means includes gear teeth 68 formed in the flange 66 of the reel 62, a coupling body comprising a reel gear 80 having a longitudinal axis extending in the direction 39 positioned in the housing member 22, an externally positioned manually operable knob member 82 having a longitudinal axis extending in the direction 39, a screw means 84 for mechanically coupling the knob 82 to the reel gear 80 and a spring disc biasing means 86 for biasing the member 82 and the reel gear 80 to a first axial position. The reel gear 80 includes a hub 88 which extends through an aperture 90 formed in a wall segment 92 of the housing member 22. The screw coupling means 84 extends through and engages the knob 82 and engages a bore 94 formed in the reel gear 80. An aperture 96 formed in the knob 82 is configured to engage a flat segment 98 of the hub 88 for rotation therewith. The screw coupling means 84 maintains the knob 82, positioned exterior to the housing 22 in engagement with the reel gear 80. This screw means 84 extends through an aperture 100 formed in the spring bias means 86, and, at the first axial position as illustrated in FIG. 5, the spring biasing disc 86 causes positioning of the knob 82 outwardly from a surface of the segment 92 of the housing member 22 and seating of the reel gear in a recess 102. This recess, formed in an inner surface of the wall segment 92, is configured to conform with the shape of the teeth of the reel gear 80. In this first axial position illustrated in FIG. 5, the location of the reel gear in the conforming recess 102 inhibits rotation of the reel gear 80. The reel gear is maintained in engagement with the gear teeth 68 of reel 62 at this first location and, since the reel gear is inhibited from rotating, the reel is also inhibited from rotating.

The knob 82 is manually operable against the biasing force of spring 86 from the first position to a second enabling position at which position the reel gear and reel may be actuated by rotation of the externally located knob 82. By pressing the knob 82 against the biasing force of the spring 86, both the knob member 82 and the reel gear 80 are advanced in an axial direction for a distance which unseats the reel gear 80 from the recess 102 thereby enabling its rotation. The reel gear is maintained in engagement with the gear teeth 68 of the reel at the second position and by rotatably actuating the knob 82, both the reel gear and the engaged reel are rotated. The strip is unwound by rotating knob 84 to provide rotation of reel 62 in a clockwise direction as viewed in FIG. 3. Upon release, the knob 82 and the reel gear which is mechanically coupled thereto are returned to the first axial position by the biasing force of the spring 86 at which location the reel gear is reseated in recess 102 and rotation of the reel gear and the reel are inhibited. An unwound strip segment is manually withdrawn by finger pressure on exterior segments 74, or, automatically by centrifugal force upon initial rotation of the housing subsequent to unwinding.

Figure 8:
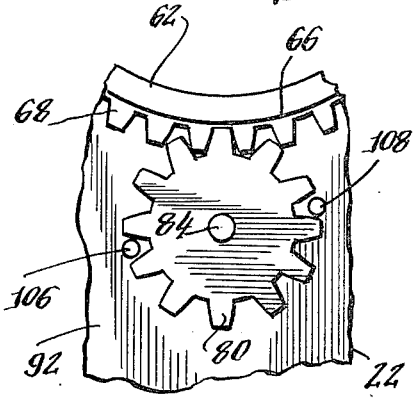
Figure 6:
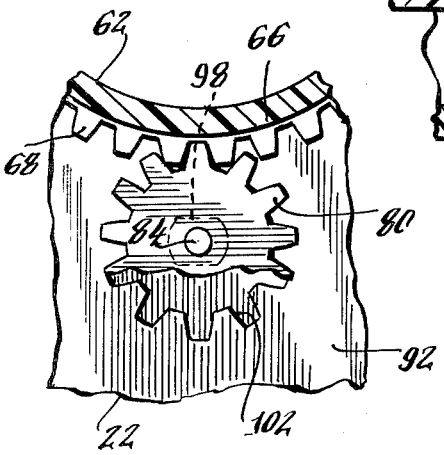
FIG. 6 is a fragmentary view, partly cut away taken along lines 6—6 of FIG. 5 and illustrating a reel gear and reel gear rotation inhibiting means.

An alternative arrangement for inhibiting rotation of the reel gear is illustrated in FIG. 8. In FIG. 8, integrally formed bodies comprising pins 106 and 108 are illustrated and extend from the surface of the wall segment 92 of the housing member 22. These pins may be integrally formed with wall segment 92 or may be mounted by adhesives, by brazing, or other similar means. In this case depressing the knob 82 and advancing it to the second axial position elevates the gear teeth of the ring gear above the pins thereby enabling rotation of the reel gear.

An improved flap sanding device has thus been described which advantageously allows the user to advance the flexible abrasive strip in order to replace worn exterior work segments. The strips are advanced without the need of disassembling the housing or removing the closure member. The advancing means is further advantageous in that a positive lock of the reel is provided which inhibits rotation of the reel.

While there has been described a particular embodiment of the invention, it will be apparent to those skilled in the art that variations may be made thereto without departing from the spirit of the invention and the scope of the appended claims.

What is claimed is:

1. An improved surface finishing device comprising:

a. a generally cylindrically shaped housing adapted to be mounted for rotation;

b. said housing having a peripheral wall segment including a slot formed therein;

c. an abrasive strip support body supported for rotation within said housing;

d. an elongated abrasive strip having a segment thereof positioned within said housing and wound about said support body;

e. said abrasive strip extending through said slot and having a working segment thereof positioned without said housing and extending in a generally radial direction;

f. means for selectively rotating said support body within said housing in a first direction for partly unwinding and advancing said strip to replace said working segment and in a second opposite direction for winding said strip about said support body;

g. said selective rotating means supported by said housing for rotation therewith and including a manually operable member mechanically coupled to said support body, said member positioned without said housing and movable from a first position in a direction toward said housing to a second position for causing rotation of said support body upon rotation of said member at said second position, said rotating means preventing rotation of said support body when rotation of said member is prevented;

h. means for preventing rotation of said member at said first position and enabling rotation of said member at said second position; and, i. means for biasing said member into said first position.

2. The finishing device of claim 1 wherein said rotating means includes a coupling body for mechanically coupling said manually operable member to said support body, said coupling body engages said support body and said manually operable member for causing rotation of said support body upon application of a manual rotary force to said manually operable member.

3. The finishing device of claim 2 wherein said inhibiting means engages said coupling body.

4. The finishing device of claim 2 wherein said support body includes a periphery having a spur gear formed therein, said coupling body is rotatably supported in said housing and includes a spur gear formed therein, and said coupling body is positioned for engagement with said support body spur gear for causing rotation of said support body upon rotation of said member.

5. In a flap sanding device having a housing adapted to be rotated, an internally positioned rotatable abrasive strip support body about which an abrasive strip is wound, said support body having a longitudinal axis thereof, said abrasive strip extending through a slot in a peripheral wall of said housing in a generally radial direction, the improvement comprising: a means for selectively rotating said strip support body in a first direction for partly unwinding and advancing said strip to replace a working segment of said abrasive strip and in a second opposite direction for winding said strip about said support body, said rotating means including a manually operable member coupled to said support body for rotation therewith and positioned external to said housing, said member having a longitudinal axis spaced transversely from said support body axis, said member manually operable between first and second axial positions, means for biasing said member at said first position, and means for preventing rotation of said member at said first position and enabling rotation of said member at said second position upon application of a manual force to said member in the direction of said member's longitudinal axis.

6. An improved flap sanding device comprising:

a. a housing inclusing a first generally cylindrically shaped member and a second disc shaped closure member;

b. said first housing member having a peripheral wall segment and an end wall segment;

c. a hub centrally positioned within the housing;

d. a support reel body rotatably positioned about said hub, said reel body having a longitudinal axis thereof;

e. said housing including a plurality of axially extending slots formed in said peripheral wall segment;

f. a plurality of elongated strips of abrasive material each having a segment thereof positioned in said housing and wound on said reel body;

g. each of said strips extending through an associated slot and providing a generally radially extending work segment without said housing;

h. a resilient body positioned adjacent each of said working segments for causing said working segments to extend in a generally radial direction;

i. means for causing rotation of said reel about said hub for partly unwinding said abrasive strips to replenish said work segments;

j. said rotating means including a manually operable member having a longitudinal axis thereof, said manually operable member supported by said end wall segment of said first housing member outside said housing and manually operable between first and second axial positions, k. said rotating means also including a coupling body having a longitudinal axis thereof for mechanically coupling said manually operable member to said reel body for causing rotation of said reel body upon rotation of said manually operable member and for preventing rotation of said reel body when rotation of said manually operable member is prevented;

l. said axes of said manually operable member and said coupling body concentrically aligned and spaced transversely from said support body axis;

m. means for biasing said manually operable member into said first axial position; and n. means for preventing rotation of said manually operable member at said first position and for enabling rotation of said member at said second axial position upon application of a manual rotary force to said member.

7. The flap sanding device of claim 6 wherein said support reel body includes a plurality of gear teeth formed thereon, said coupling body comprises a reel gear having a plurality of gear teeth, said support reel body and coupling body are positioned for providing mutual engagement between said gear teeth at said first and second axial positions of said manually operable member and said inhibiting means comprises means for engaging the gear teeth of said reel gear at said first axial position of said manually operable member and inhibiting rotation thereof.

8. The flap sanding device of claim 7 wherein said inhibiting means comprises a recess formed in said end wall segment of said housing for engaging said reel gear.

9. The flap sanding device of claim 8 wherein said recess is configured to conform with a shape of the gear teeth of said reel gear.

10. The flap sanding device of claim 7 wherein said inhibiting means comprises a body extending from a surface of said housing for engaging said reel gear at said first position.

11. The flap sanding device of claim 10 wherein said inhibiting body comprises a pin shaped body.

12. The flap sanding device of claim 6 wherein said device is adapted to be mounted on a spindle, said disc shaped housing member is demountably supported on said first housing member, said second disc shaped housing member is positioned innermost on said spindle with respect to said first member and said end wall segment of said first member is positioned outermost on said spindle.

* * * * *